US008864046B2

(12) United States Patent
Chen et al.

(10) Patent No.: US 8,864,046 B2
(45) Date of Patent: Oct. 21, 2014

(54) CLOSED NEBULIZING SYSTEM FOR REMOVING BUBBLES

(75) Inventors: Shih-Chang Chen, Hsinchu (TW); Shih-Che Chiu, Hsinchu (TW); Tsung-Pat Chou, Hsinchu (TW)

(73) Assignee: Microjet Technology Co., Ltd., Hsinchu (TW)

( * ) Notice: Subject to any disclaimer, the term of this patent is extended or adjusted under 35 U.S.C. 154(b) by 332 days.

(21) Appl. No.: 13/273,435

(22) Filed: Oct. 14, 2011

(65) Prior Publication Data

US 2012/0090710 A1 Apr. 19, 2012

(30) Foreign Application Priority Data

Oct. 13, 2010 (CN) ..... 2010 1 0517976

(51) Int. Cl.
*B05B 1/08* (2006.01)

(52) U.S. Cl.
USPC ..... 239/102.2; 239/102.1; 239/104; 239/124; 239/338; 239/552; 239/553.3; 239/575; 239/590.3

(58) Field of Classification Search
USPC ..... 239/102.1, 102.2, 104, 124, 127, 338, 239/552, 553, 553.3, 590, 590.3, 575, 239/DIG. 23; 128/200.14, 200.16
See application file for complete search history.

(56) References Cited

U.S. PATENT DOCUMENTS 5,487,378 A * 1/1996 Robertson et al. ..... 128/200.16
5,586,723 A * 12/1996 Chen et al. ..... 239/102.2
6,550,472 B2 * 4/2003 Litherland et al. ..... 239/338

* cited by examiner

*Primary Examiner* — Steven J Ganey
(74) *Attorney, Agent, or Firm* — Kirton McConkie; Evan R. Witt

(57) ABSTRACT

A closed nebulizing system for removing bubbles includes a first pump, a nebulizing module and a second pump. The first pump is for providing a fluid. The nebulizing module includes an outlet channel, an inlet channel connected with the first pump, and a plurality of nozzles for nebulizing and ejecting part of the fluid. The second pump is connected with the outlet channel for outputting non-nebulized fluid. The first pump, the nebulizing module and the second pump form a closed fluid loop, so that the fluid continuously contacts with the plurality of nozzles and bubbles generated during nebulization process are evacuated from the nebulizing module.

9 Claims, 9 Drawing Sheets

5

CLOSED NEBULIZING SYSTEM FOR REMOVING BUBBLES

FIELD OF THE INVENTION

The present invention relates to a nebulizing system, and more particularly to a nebulizing system for removing bubbles.

BACKGROUND OF THE INVENTION

The nebulizer is an electronic device for transforming fluid into lots of droplets. Since the contact surface area of the droplet is larger than that of the fluid, the nebulizer is widely used in many fields, such as medical treatment, cosmetic, environmental humidification, indoor essential oil spray, and even heat-dissipation for electronic device. The commercially available nebulizer nowadays mainly includes the ultrasonic nebulizer and the actuated nebulizer.

FIG. 1 is a schematic cross-section view illustrating the conventional actuated nebulizer. The conventional actuated nebulizer 1 comprises a cavity structure 10, a nebulizing sheet 11, and an actuating component 12. The cavity structure 10 has an inlet channel 101 and a receiving chamber 102, and the fluid 103 is inputted from the inlet channel 101 and received in the receiving chamber 102. The nebulizing sheet 11 has a plurality of nozzles 111 corresponding to the receiving chamber 102. The operation of the conventional actuated nebulizer 1 is to make the fluid 103 in contact with the nebulizing sheet 11 by gravity and trigger the actuating component 12 by a voltage to result in the vibration of the nebulizing sheet 11, so that the fluid 103 is nebulized to form droplets 1031 through the nozzles 111.

Please refer to FIG. 1 again. The conventional actuated nebulizer 1 relies on gravity to make the fluid 103 flow down and contact with the nozzles 111 of the nebulizing sheet 11, so as to enable the nebulization of the fluid 103 to form the droplets 1031. Therefore, the nebulizing direction of the conventional actuated nebulizer 1 is limited to the gravity direction, so the conventional actuated nebulizer 1 has to be disposed in a single direction. In addition, when the receiving chamber 102 of the cavity structure 10 is too deep or the diameters of the nozzles of the nebulizing sheet 11 are too big, the fluid 103 is easy to be accumulated on the surface of the nozzles 111, which causes block of the nozzles 111 and bad nebulization. Further, when the fluid 103 is nebulized into droplets 1031, some air enters the cavity structure 10 through the nozzles 111 of the nebulizing sheet 11 and forms a bubble 104 in the upper portion of the receiving chamber 102, which also causes unstable nebulization.

Therefore, there is a need of providing a closed nebulizing system for removing bubbles in order to obviate the drawbacks encountered from the prior art.

SUMMARY OF THE INVENTION

The present invention provides a closed nebulizing system for removing bubbles. The closed nebulizing system includes a first pump, a nebulizing module and a second pump connected in series to form a closed fluid loop, so as to obviate the drawbacks (e.g. the limited nebulizing direction and unstable nebulization) of the conventional actuated nebulizer.

In accordance with an aspect of the present invention, there is provided a closed nebulizing system for removing bubbles. The closed nebulizing system includes a first pump, a nebulizing module and a second pump. The first pump is for providing a fluid. The nebulizing module includes an outlet channel, an inlet channel connected with the first pump, and a plurality of nozzles for nebulizing and ejecting part of the fluid. The second pump is connected with the outlet channel for outputting non-nebulized fluid. The first pump, the nebulizing module and the second pump form a closed fluid loop, so that the fluid continuously contacts with the plurality of nozzles and bubbles generated during nebulization process are evacuated from the nebulizing module.

In accordance with another aspect of the present invention, there is provided a closed nebulizing system for removing bubbles. The closed nebulizing system includes a first pump, a nebulizing module, a second pump and a porous material. The first pump is for providing a fluid. The nebulizing module includes a cavity structure for receiving the fluid, an outlet channel communicated with the cavity structure, an inlet channel connected with the first pump and the cavity structure, and a plurality of nozzles for nebulizing and ejecting part of the fluid. The second pump is connected with the outlet channel for outputting non-nebulized fluid. The porous material is disposed in the cavity structure for absorbing the fluid and enabling the fluid to continuously contact with the plurality of nozzles for nebulization. The first pump, the nebulizing module and the second pump form a closed fluid loop, so that the fluid continuously contacts with the plurality of nozzles and bubbles generated during nebulization process are evacuated from the nebulizing module.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
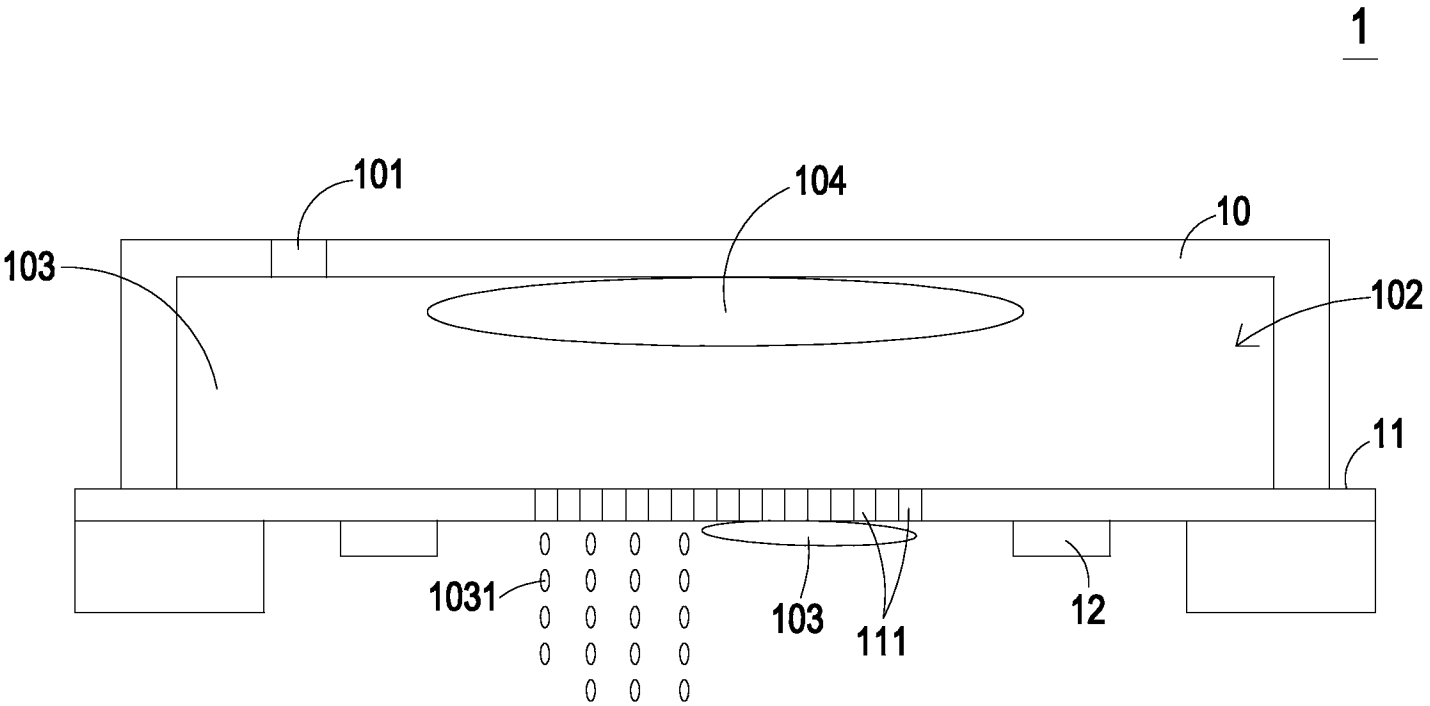
FIG. 1 PRIOR ART
FIG. 1 is a schematic cross-section view illustrating the conventional actuated nebulizer.
Figure 2:
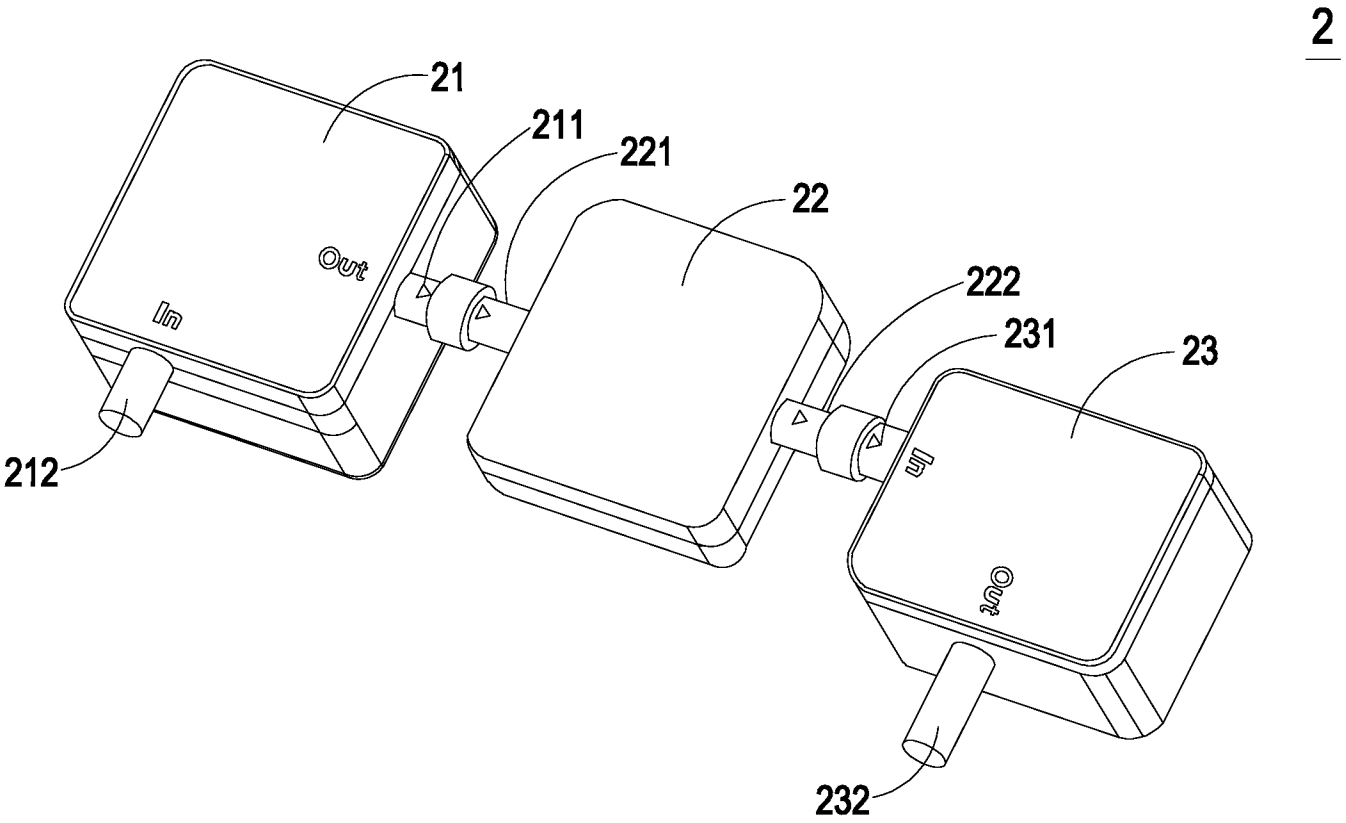
FIG. 2 is a schematic view illustrating a closed nebulizing system according to a first embodiment of the present invention.

FIG. 2 is a schematic view illustrating a closed nebulizing system according to a first embodiment of the present invention. As shown in FIG. 2, the nebulizing system 2 comprises a first pump 21, a nebulizing module 22 and a second pump 23. The nebulizing module 22 includes an inlet channel 221 and an outlet channel 222. The first pump 21 and the second pump 23 are piezoelectric pumps, and each has one single inlet and one single outlet. The outlet 211 of the first pump 21 and the inlet 231 of the second pump 23 are connected with the inlet channel 221 and the outlet channel 222 of the nebulizing module 22, respectively, and the inlet 212 of the first pump 21 and the outlet 232 of the second pump 23 are connected with each other through a transmission tube (not shown), so that the first pump 21, the nebulizing module 22 and the second pump 23 are connected in series to form a closed fluid loop and enable the fluid to flow in the closed fluid loop.

Figure 3A:
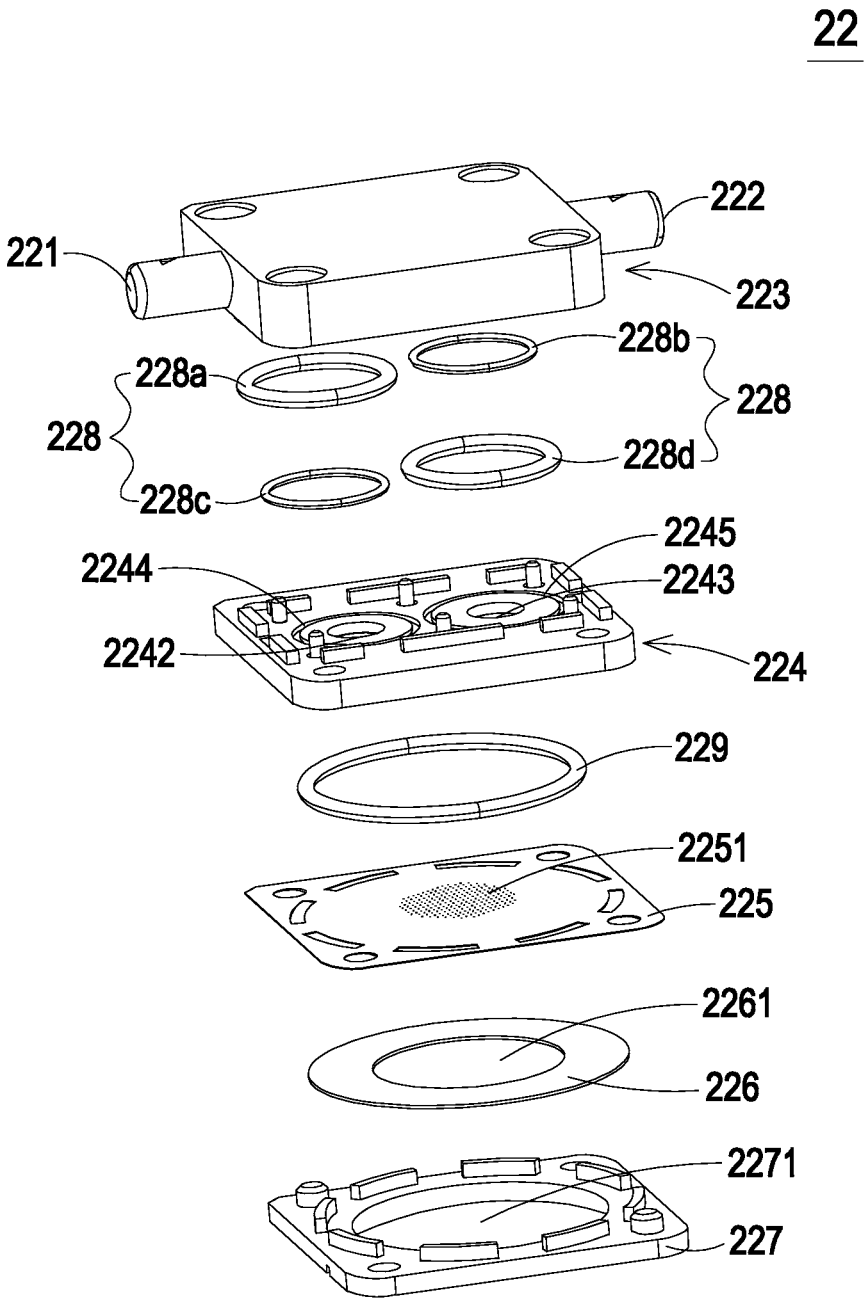
FIG. 3A is a schematic exploded view illustrating the nebulizing module of FIG. 2.

FIG. 3A is a schematic exploded view illustrating the nebulizing module of FIG. 2. As shown in FIG. 3A, the nebulizing module 22 includes a cover 223, a cavity structure 224, a nebulizing unit 225, an actuating component 226, a base 227 and a plurality of sealing components 228 and 229. The nebulizing module 22 is formed by sequentially assembling the cover 223, the sealing components 228, the cavity structure 224, the sealing component 229, the nebulizing unit 225, the actuating component 226 and the base 227.

Figure 3B:
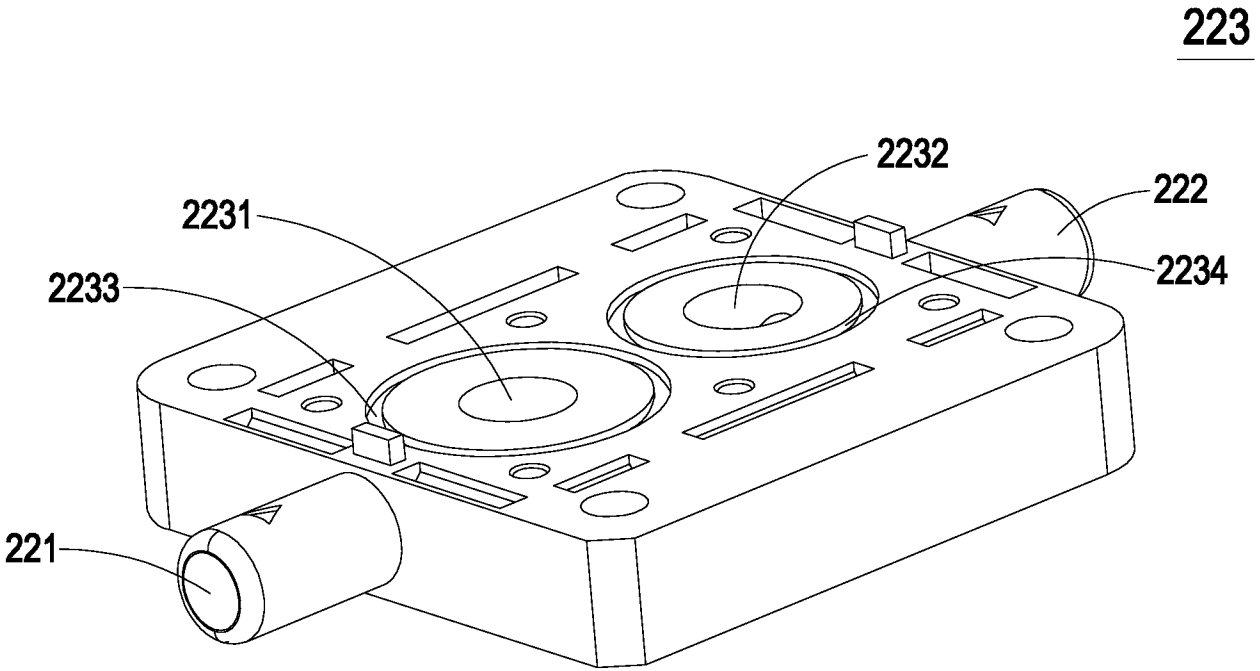
FIG. 3B is a schematic rear view illustrating the cover of FIG. 3A.

Please refer to FIG. 3B and FIG. 3A, wherein FIG. 3B is a schematic rear view illustrating the cover of FIG. 3A. As shown in FIG. 3A and FIG. 3B, the cover 223 includes a first outlet 2231 and a first inlet 2232, wherein the inlet channel 221 and the outlet channel 222 are communicated with the first outlet 2231 and the first inlet 2232, respectively. In addition, the cover 223 has recesses 2233 and 2234 surrounding the first outlet 2231 and the first inlet 2232, respectively, for having the circular sealing components 228*a* and 228*b* received in the recesses 2233 and 2234, respectively, according to their corresponding sizes.

Figure 3C:
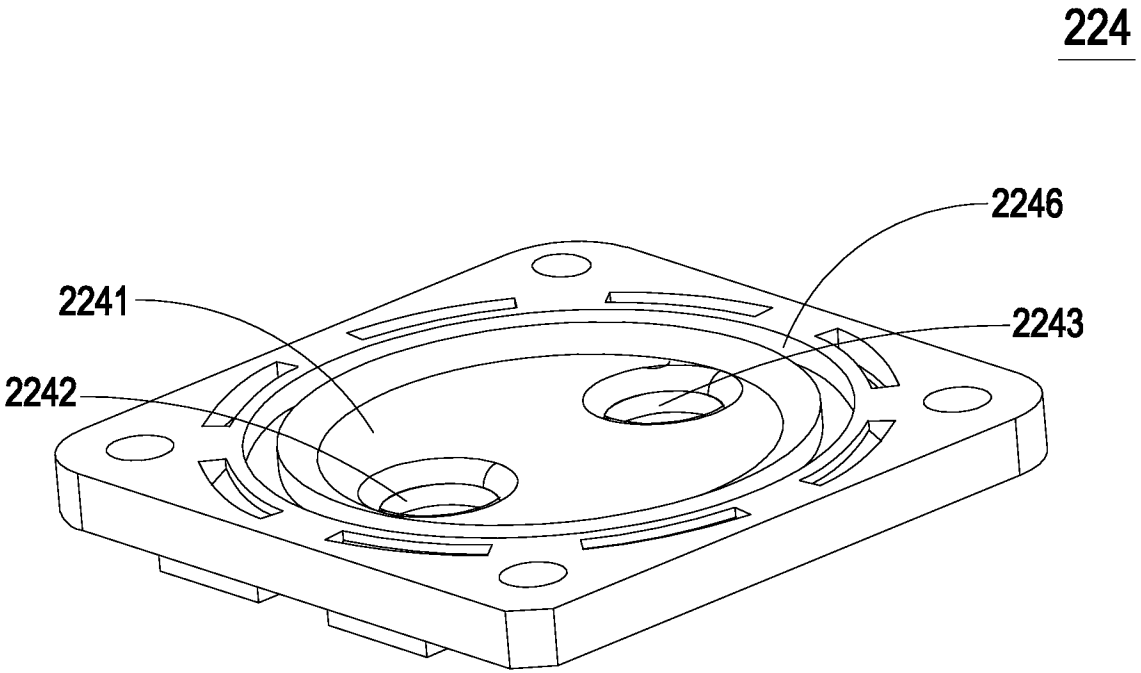
FIG. 3C is a schematic rear view illustrating the cavity structure of FIG. 3A.

Please refer to FIG. 3C and FIG. 3A, wherein FIG. 3C is a schematic rear view illustrating the cavity structure of FIG. 3A. As shown in FIG. 3A and FIG. 3C, the cavity structure 224 includes a receiving chamber 2241, a first through hole 2242 and a second through hole 2243. The cavity structure 224 further includes recesses 2244 and 2245 surrounding the first through hole 2242 and the second through hole 2243, respectively, for having the circular sealing components 228*c* and 228*d* received in the recesses 2244 and 2245, respectively, according to their corresponding sizes. As such, the cover 223 and the cavity structure 224 are tightly assembled together by means of the sealing components 228*a*, 228*b*, 228*c* and 228*d*, so as to prevent the fluid from leaking out.

Moreover, as shown in FIG. 3C, the cavity structure 224 further includes a recess 2246 surrounding the receiving chamber 2241 for having the circular sealing component 229 received in the recess 2246. As such, the cavity structure 224 and the nebulizing unit 225 are tightly assembled together by means of the sealing component 229, so as to prevent the fluid from leaking out.

Please refer to FIG. 3A again. The nebulizing unit 225 is a nebulizing sheet having a plurality of nozzles 2251. The plurality of nozzles 2251 are corresponding to the receiving chamber 2241 of the cavity structure 224 for nebulizing and ejecting the fluid contained in the receiving chamber 2241. The actuating component 226 is a circular piezoelectric sheet having a central opening 2261 corresponding to the plurality of nozzles 2251 of the nebulizing unit 225. The base 227 also has an opening 2271 corresponding to the opening 2261 of the actuating component 226 and the plurality of nozzles 2251 of the nebulizing unit 225, so that the nebulized droplets can be ejected through the opening 2271.

Figure 4A:
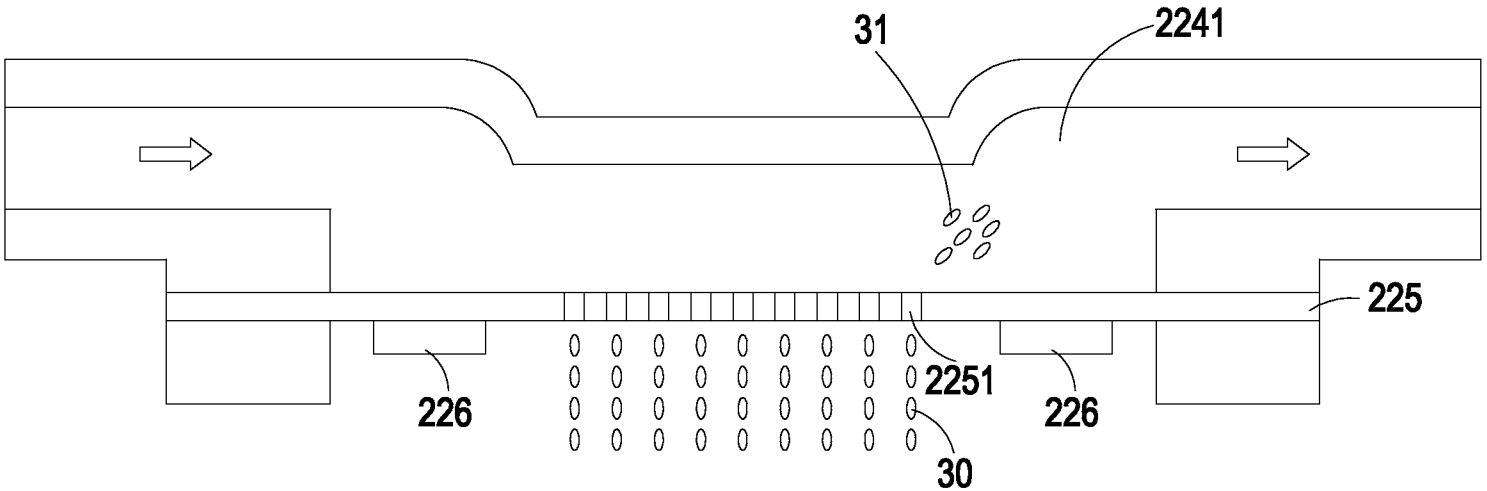
FIG. 4A is a schematic cross-section view illustrating the nebulizing module of FIG. 3A in operation status.

Please refer to FIG. 4A, FIG. 3A and FIG. 2, wherein FIG. 4A is a schematic cross-section view illustrating the nebulizing module of FIG. 3A in operation status. During the operation of the nebulizing system 2, the first pump 21 transports the fluid into the nebulizing module 22 through the inlet channel 221, and then, the fluid is transported to the receiving chamber 2241 through the first outlet 2231 of the cover 223 and the first through hole 2242 of the cavity structure 224. When the actuating component 226 is triggered by a voltage, the nebulizing unit 225 is vibrated accordingly, and thus, part of the fluid in the receiving chamber 2241 is ejected out through the nozzles 2251 to form the nebulized droplets 30. Meanwhile, the non-nebulized fluid is transported to the second pump 23 through the second through hole 2243 of the cavity structure 224, the first inlet 2232 of the cover 223 and the outlet channel 222 of the nebulizing module 22 by the suction of the second pump 23. Subsequently, the non-nebulized fluid is transported to the first pump 21 again through the transmission tube. Therefore, the nebulizing module 22 can continuously perform the nebulization function since the fluid is provided in a circulating loop.

In addition, when the nebulized droplets 30 are ejected through the nozzles 2251, some air may enter the receiving chamber 2241 and form bubbles 31. At the meantime, since the first pump 21 and the second pump 23 are operated to continuously supplement the fluid into the closed fluid loop, the bubbles 31 can be evacuated from the receiving chamber 2241 with the flow of the fluid. Hence, the fluid is able to continuously contact the nozzles 2251, and the bubbles 31 are prevented from accumulating in the receiving chamber 2241, so as to improve the nebulization stability of the nebulizing system 2.

Furthermore, since the first pump 21 and the second pump 23 continuously supplement the fluid into the closed fluid loop, and the nebulizing frequency and the nebulizing amount of the nebulizing module 22 and the output flow and the input flow of the first pump 21 and the second pump 23 can be adjusted, the nebulizing system 2 can still be normally operated even when it is turned upside down. Therefore, the nebulizing system 2 can perform nebulization in different directions according to different requirements without limited in the gravity direction.

Figure 4B:
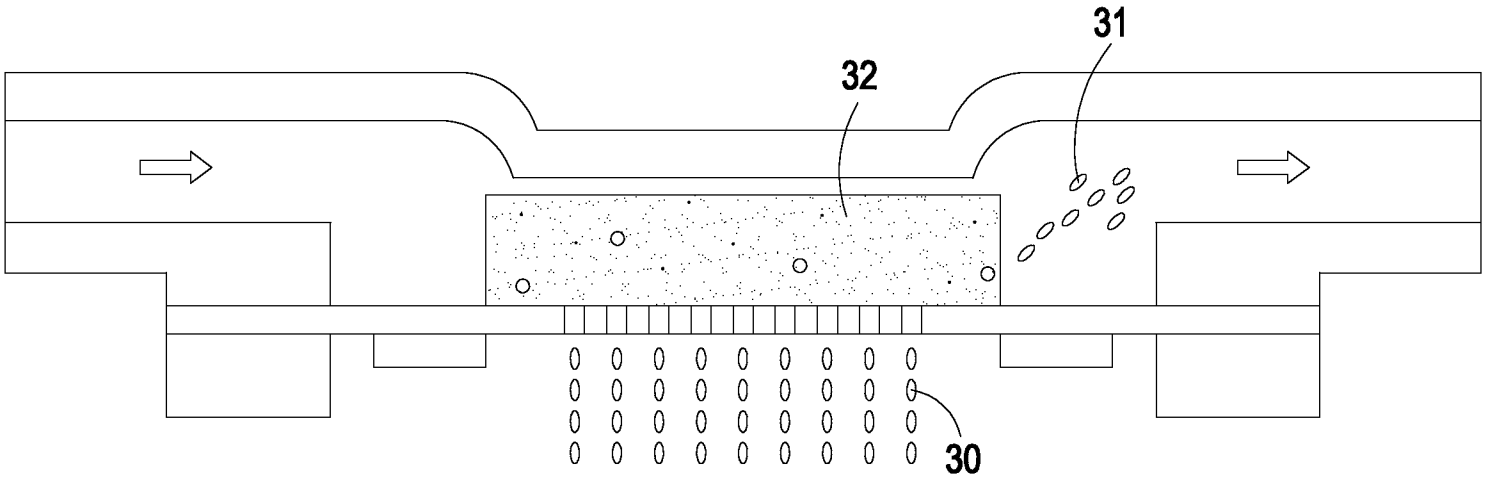
FIG. 4B is a schematic cross-section view illustrating the nebulizing module of FIG. 4A having a porous material contained in the receiving chamber.

In some embodiments, the receiving chamber 2241 further includes a porous material 32, such as a sponge, contained therein, as shown in FIG. 4B. The porous material 32 continuously contacts the nozzles 2251 and is used to absorb the fluid. As such, through supplementing the fluid to the porous material 32 at fixed time and amount by the first pump 21 and the second pump 23, the porous material 32 can keep wet and continuously contact the nozzles 2251, so that the fluid can be stably nebulized.

Figure 5:
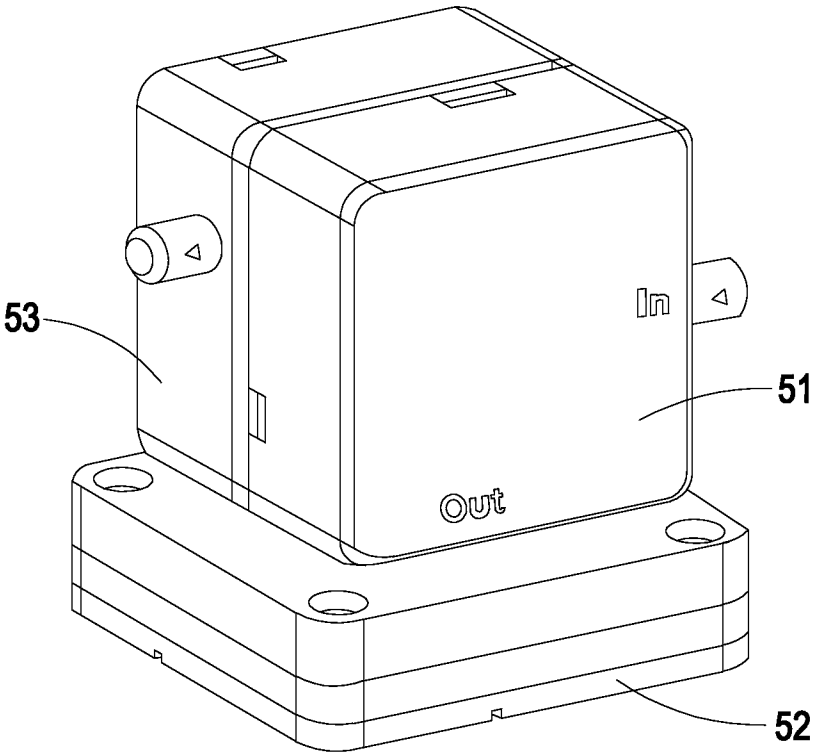
FIG. 5 is a schematic view illustrating the closed nebulizing system according to a second embodiment of the present invention.
Figure 6:
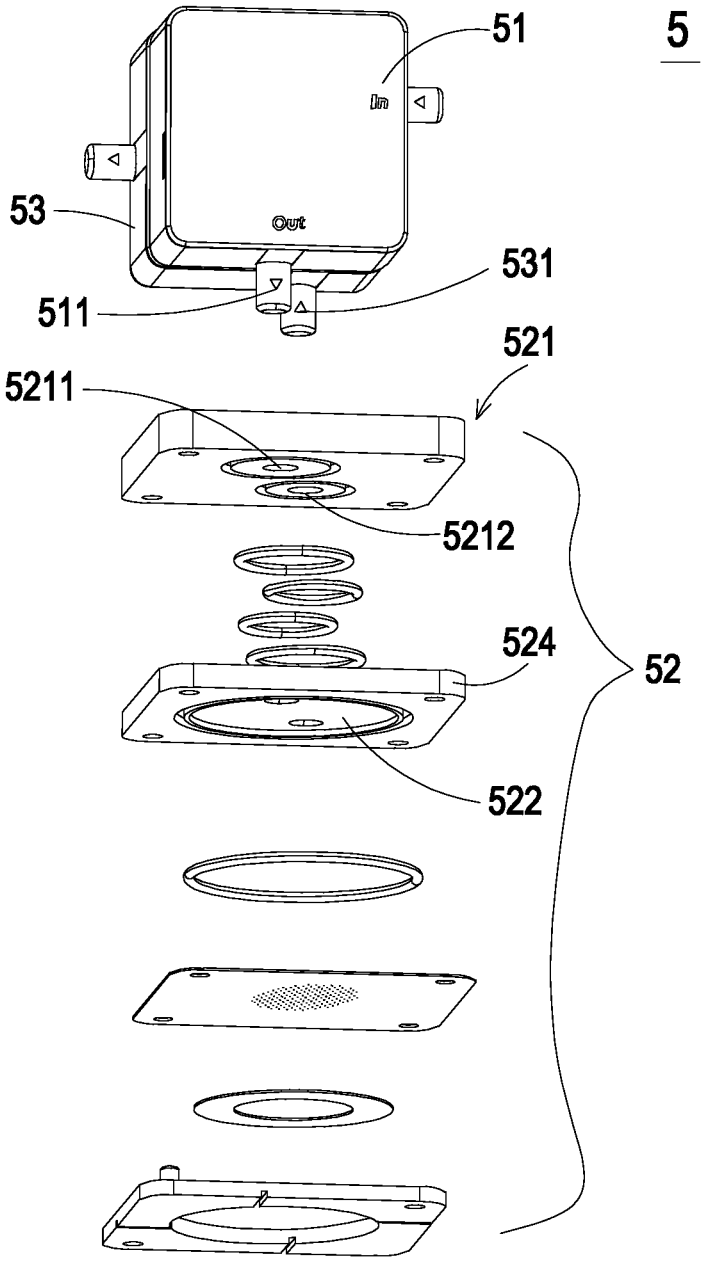
FIG. 6 is a schematic exploded view illustrating the closed nebulizing system of FIG. 5.

Certainly, the nebulizing module and the first and the second pumps are not limited to be disposed in a single direction. Please refer to FIG. 5 and FIG. 6, wherein FIG. 5 is a schematic view illustrating the closed nebulizing system according to a second embodiment of the present invention, and FIG. 6 is a schematic exploded view illustrating the closed nebulizing system of FIG. 5. The operations and functions of the first pump 51, the nebulizing module 52 and the second pump 53 are similar to those of the embodiment shown in FIG. 2, and are not redundantly described here. As shown in FIG. 5 and FIG. 6, the cover 521 of the nebulizing module 52 has an inlet channel 5211 and an outlet channel 5212, which are connected with the outlet 511 of the first pump 51 and the inlet 531 of the second pump 53, respectively, and provided for the fluid input and output. By means of the different design for the locations of the inlet channel 5211 and the outlet channel 5212, the first pump 51 and the second pump 53 can be disposed on the nebulizing module 52, so as to reduce the volume of the closed nebulizing system 5. When the closed nebulizing system 5 is operated, the first pump 51 provides the fluid to the receiving chamber 522 of the cavity structure 524 through the inlet channel 5211 for further nebulization. Also, the non-nebulized fluid flow to the second pump 53 through the outlet channel 5212 by the suction of the second pump 53. As to the nebulization process, it is similar to that of the first embodiment and is not redundantly described here.

In conclusion, the present invention provides the closed nebulizing system for removing bubbles. The first pump, the nebulizing module and the second pump are connected in series to form the closed fluid loop, and thus, the bubbles in the receiving chamber generated during the nebulization process can be evacuated from the receiving chamber with the flow of the fluid, and the nebulizing system can perform nebulization in different directions without limited in the gravity direction. Moreover, the fluid in the closed fluid loop can continuously contact the plurality of nozzles of the nebulizing unit, so that the nebulization stability of the nebulizing system can be significantly improved. In views of the above benefits, the closed nebulizing system of the present invention is advantageous over the conventional actuated nebulizer and possesses high industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A closed nebulizing system for removing bubbles, said closed nebulizing system comprising:
- a first pump having one single inlet and one single outlet for providing a fluid;
- a nebulizing module comprising:
  - an outlet channel;
  - an inlet channel connected with said outlet of said first pump; and
  - a plurality of nozzles for nebulizing and ejecting part of said fluid; and
- a second pump having one single inlet and one single outlet, said inlet of said second pump being connected with said outlet channel for outputting non-nebulized said fluid,
- wherein said first pump and said second pump are piezoelectric pumps and said inlet of said first pump and said outlet of said second pump are connected with each other through a transmission tube, so that said first pump, said nebulizing module and said second pump form a closed fluid loop, and said fluid continuously contacts with said plurality of nozzles and bubbles generated during nebulization process are evacuated from said nebulizing module.

2. The closed nebulizing system according to claim 1 wherein said nebulizing module comprises:
- a cover;
- a cavity structure having a receiving chamber for receiving said fluid;
- a base having an opening;
- a nebulizing unit having said plurality of nozzles;
- an actuating component having an opening; and
- a plurality of sealing components,
- wherein said nebulizing module is formed by sequentially assembling said cover, said sealing components, said cavity structure, said sealing component, said nebulizing unit, said actuating component and said base, and said opening of said actuating component and said opening of said base are corresponding to said plurality of nozzles.

3. The closed nebulizing system according to claim 2 wherein said cover comprises a first outlet and a first inlet, and said inlet channel and said outlet channel are communicated with said first outlet and said first inlet, respectively.

4. The closed nebulizing system according to claim 3 wherein said cover has recesses surrounding said first outlet and said first inlet, respectively, for having said sealing components received in said recesses, respectively, and said cover is connected with said cavity structure.

5. The closed nebulizing system according to claim 2 wherein said cavity structure further comprises a first through hole, a second through hole and recesses surrounding said first through hole and said second through hole, respectively, for having said sealing components received in said recesses, respectively, so that said cavity structure and said cover are tightly assembled to prevent said fluid from leaking out.

6. The closed nebulizing system according to claim 2 wherein said cavity structure further comprises a recess for having one of said plurality of sealing components received in said recess, so that said cavity structure and said nebulizing module are tightly assembled to prevent said fluid from leaking out.

7. The closed nebulizing system according to claim 2 wherein said nebulizing unit is a nebulizing sheet having said plurality of nozzles corresponding to said receiving chamber for nebulizing and ejecting part of said fluid.

8. The closed nebulizing system according to claim 2 wherein said actuating component is a circular piezoelectric sheet, and is triggered by a voltage to result in vibration of said nebulizing unit for nebulizing and ejecting part of said fluid.

9. A closed nebulizing system for removing bubbles, said closed nebulizing system comprising:
- a first pump for providing a fluid;
- a nebulizing module comprising:
  - a cavity structure for receiving said fluid;
  - an outlet channel communicated with said cavity structure;
  - an inlet channel connected with said first pump and said cavity structure; and
  - a plurality of nozzles for nebulizing and ejecting part of said fluid;
- a second pump connected with said outlet channel for outputting non-nebulized said fluid; and
- a porous material disposed in said cavity structure for absorbing said fluid and enabling said fluid to continuously contact with said plurality of nozzles for nebulization;
- wherein said first pump, said nebulizing module and said second pump form a closed fluid loop, so that said fluid continuously contacts with said plurality of nozzles and bubbles generated during nebulization process are evacuated from said nebulizing module.

* * * * *